US008201566B2

(12) United States Patent
Dumler et al.

(10) Patent No.: US 8,201,566 B2
(45) Date of Patent: Jun. 19, 2012

(54) COSMETIC BRUSH WITH MANY BRISTLES FOR APPLYING A COSMETIC PRODUCT

(75) Inventors: Norbert Dumler, Ansbach (DE); Daniela Kulik, Feuchtwangen (DE)

(73) Assignee: Geka Brush GmbH, Bechhofen (DE)

( * ) Notice: Subject to any disclaimer, the term of this patent is extended or adjusted under 35 U.S.C. 154(b) by 360 days.

(21) Appl. No.: 12/121,569

(22) Filed: May 15, 2008

(65) Prior Publication Data

US 2008/0283078 A1 Nov. 20, 2008

(30) Foreign Application Priority Data

May 15, 2007 (EP) ..... 07009674

(51) Int. Cl.
*A45D 40/26* (2006.01)

(52) U.S. Cl. ..... 132/218

(58) Field of Classification Search ..... 132/216, 132/217, 218, 320, 317, 318, 120, 313; 401/123, 401/125, 129, 126; 15/160, 207.2
See application file for complete search history.

(56) References Cited

U.S. PATENT DOCUMENTS

| | | | | |
|---|---|---|---|---|
| 4,632,136 | A * | 12/1986 | Kingsford | 132/218 |
| 4,964,429 | A * | 10/1990 | Cole | 132/218 |
| 5,238,011 | A | 8/1993 | Gueret | |
| 5,709,230 | A * | 1/1998 | Miraglia | 132/218 |
| 5,765,573 | A | 6/1998 | Gueret | |
| 6,059,473 | A | 5/2000 | Gueret | |
| 6,073,634 | A | 6/2000 | Gueret | |
| 6,427,700 | B1 * | 8/2002 | Leone et al. | 132/218 |
| 6,481,445 | B1 * | 11/2002 | Miraglia | 132/218 |
| 6,923,187 | B2 * | 8/2005 | Montoli et al. | 132/218 |
| 7,261,483 | B2 * | 8/2007 | Gueret | 401/126 |
| 2002/0088473 | A1 * | 7/2002 | Fonseca et al. | 132/218 |
| 2003/0150075 | A1 | 8/2003 | Montoli et al. | |
| 2003/0150076 | A1 * | 8/2003 | Montoli et al. | 15/206 |
| 2003/0230317 | A1 * | 12/2003 | Montoli et al. | 132/218 |
| 2005/0034740 | A1 * | 2/2005 | Eckers et al. | 132/218 |
| 2006/0076031 | A1 | 4/2006 | Hartstock et al. | |
| 2006/0162737 | A1 * | 7/2006 | Montoli | 132/218 |
| 2006/0225760 | A1 * | 10/2006 | Kearney | 132/218 |
| 2008/0011317 | A1 * | 1/2008 | Malvar et al. | 132/218 |

(Continued)

FOREIGN PATENT DOCUMENTS

DE 2559273 A1 7/1977

(Continued)

OTHER PUBLICATIONS

ISO 868:2003(E); Plastics and ebonite—Determination of indentation hardness by means of a durometer (Shore hardness); Third edition.

(Continued)

*Primary Examiner* — Todd Manahan
*Assistant Examiner* — Vanitha Elgart
(74) *Attorney, Agent, or Firm* — Browdy and Neimark, PLLC

(57) ABSTRACT

The cosmetic brush, which is in particular a mascara brush, includes a bristle portion with a base body and a plurality of bristles that stick out from the base body in a radial direction and serve for the application of a cosmetic product. The bristles have a high bristle density of at least 6 bristles per square millimeter and consist of a plastic material that has a Shore hardness D of more than 40.

16 Claims, 2 Drawing Sheets

U.S. PATENT DOCUMENTS

| | | | | |
|---|---|---|---|---|
| 2008/0041407 | A1* | 2/2008 | Kearney | 132/218 |
| 2008/0178901 | A1* | 7/2008 | Montoli | 132/218 |
| 2009/0193602 | A1* | 8/2009 | Dumler et al. | 15/160 |

FOREIGN PATENT DOCUMENTS

| | | | |
|---|---|---|---|
| EP | 0509852 | A1 | 10/1992 |
| EP | 0694266 | A1 | 1/1996 |
| EP | 0761125 | A1 | 3/1997 |
| EP | 0861617 | A1 | 9/1998 |
| EP | 1066771 | A1 | 1/2001 |
| EP | 1647202 | A1 | 4/2006 |
| GB | 2352167 | A | 1/2001 |

OTHER PUBLICATIONS

ISO 1183-2:2004(E); Plastics—Methods for determining the density of non-cellular plastics—Part 2: Density gradient column method; First edition.

* cited by examiner

COSMETIC BRUSH WITH MANY BRISTLES FOR APPLYING A COSMETIC PRODUCT

BACKGROUND OF THE INVENTION

1. Field of the Invention

The invention relates to a cosmetic brush, in particular a mascara brush or a brush for dying hair, comprising a bristle portion with a base body and a plurality of bristles that stick out from the base body and serve for the application of a cosmetic product.

2. Background Art

Such a cosmetic brush and a corresponding injection molding process are for example described in DE 25 59 273 A1. The base body that is described there is hollow and forms one piece with the bristles. A thermoplastic, elastically deformable plastic material is used, such as an elastically resilient polyethylene. This makes the bristles soft and elastic, thus guaranteeing a very pleasant feeling when applying the cosmetic product. Plastic materials that are currently used in such injection molding processes usually have a Shore hardness A in the range of between 60 and 95, the Shore hardness being determined according to DIN EN ISO 868. Moreover, the density of relatively soft polyolefins that are popularly used in this field is determined according to DIN EN ISO 1183 and is typically in the range of between 0.91 g/cm$^3$ and 0.94 g/cm$^3$. The use of such flexible plastic materials however also involves several restrictions as far as economically feasible designs of the cosmetic brush are concerned. In addition to that, the chemical compatibility of these relatively soft and elastic materials such as polyethylene and polypropylene with the cosmetic product to be applied is often unsatisfactory.

Along with conventional mascara brushes in which a plurality of bristles are held in place between a wire portion that is bent in the shape of a hairpin by twisting the wire portion, an increasing number of brushes that are available on the market is now produced by injection molding as described above. The bristles of these brushes are also produced by injection molding, i.e. they are not bristles in the conventional sense. For the sake of simplicity, however, this term will be retained throughout the text.

SUMMARY OF THE INVENTION

The object of the invention is to provide a cosmetic brush of the above type that can be produced in a cost-effective manner and has good transfer properties in terms of the cosmetic product to be applied while separating and combing lashes or hair in a satisfactory manner during the application.

This object is attained by a cosmetic brush comprising a bristle portion with a base body and a plurality of bristles that stick out from the base body and serve for the application of a cosmetic product, wherein the bristles have a high bristle density of at least 6 bristles per square millimeter and consist of a plastic material that has a Shore hardness D of more than 40.

The inventive cosmetic brush advantageously has a very high bristle density. Unlike conventional mascara brushes that have so far been produced by injection molding and have a maximum of approximately 500 to 600 bristles, an inventive cosmetic brush may have a considerably larger number of bristles of for example at least 800 bristles and advantageously even at least 1000 bristles. Even larger numbers of bristles of 1500 and more are also conceivable.

A high bristle density is particularly advantageous if the cosmetic product is to be applied to very fine hairs or lashes.

The high bristle density of the inventive cosmetic brush however also accounts for excellent combing and separating properties in terms of hair or lashes, respectively, when used in other applications. This also applies in particular to lashes that are relatively short or extend downwards. Such exceptional conditions cannot be handled satisfactorily by means of conventional cosmetic brushes and are particularly common in Asian or older women. With the inventive cosmetic brush on the other hand, excellent results are achieved even under such difficult conditions. Moreover, a high bristle density facilitates a very even distribution of the cosmetic product to be applied. A higher number of bristles also increases the number of carrier elements that are available for transferring the cosmetic product from a receptacle to the application site. Finally, a high bristle density in which the bristles are in close proximity to each other facilitates the so-called curling effect in which the eye lashes are curled upwards by rolling the cosmetic brush up and away from the eyes. This advantage is particularly appreciated by Asian consumers, wherein the cosmetic brushes used in this region have in particular relatively small diameters since single eyelids are a very common phenomenon in this region.

It has also been found that the advantageous high bristle densities are hardly obtainable by means of the soft plastic materials that have been used so far. In order to achieve the described application goal for the target group of older women and Asian women, however, it is of vital importance to provide cosmetic brushes having high bristle densities. In relatively small brushes, this high bristle density can only be achieved by reducing the bristle dimensions to an extremely low level which is impossible, however, by means of the plastic materials that have been used so far since the plastic materials used in prior art are too soft.

In contrast, the invention uses a considerably harder plastic material than used in prior art. Determined in particular according to DIN EN ISO 868, the Shore hardness D of the plastic material used for the inventive cosmetic brush has a value of more than 40 and therefore clearly exceeds the Shore hardness values of the plastic materials used so far in the injection molding of cosmetic brushes. It is the harder plastic material of the invention that enables high bristle densities to be produced in a cost-effective manner in the first place. In addition to that, the material provides in particular the stiffness and flexibility required for the relatively small bristles. Advantageously, the used plastic materials do not contain plasticizers.

At the same time, it turned out that contrary to expectations, the use of the harder plastic material hardly affects the comfortable application provided by the inventive brush. Combined with the small cross-sectional geometry of the bristles that is in particular due to the high bristle density and creates a pleasant feeling of softness despite the hard plastic material, this results in an application that is almost as pleasant as with a conventional brush whose bristles are made of a softer plastic material.

The following is a description of favorable embodiments of the invention.

An embodiment is favorable if the plastic material has a Shore hardness D of at least 45 and in particular of at most 60, which provides for particularly high bristle densities and guarantees easy production of brushes with a number of bristles of for example more than 2000—in particular also by injection molding.

Moreover, the bristle density may also amount to a maximum of 50 bristles per square millimeter. On the one hand, bristle densities up to this preferred limit allow for all possible applications, even if the cosmetic product is to be applied to very fine structures. On the other hand, these bristle densities are still very easily produced.

In another favorable embodiment, a trim length of the bristle portion along which bristles are disposed extends in the direction of a central axis and amounts to between 18 mm and 30 mm, thus covering all longitudinal extensions that are typically common in the application range.

Bristles disposed next to each other on a surface of the base body preferably have a base distance of at most 0.63 mm with respect to each other. This narrow distance improves the combing and separating properties and is favorable to the curling effect.

Another advantageous embodiment in which the bristles disposed on a surface of the base body have a base diameter of at most 0.3 mm, in particular of at most 0.18 mm, ensures a particularly high packing density of the bristles.

Moreover, an embodiment is favorable if the bristles have a bristle length of at most 2.5 mm and stick out from a surface of the base body.

Another embodiment is preferred in which the base body has a diameter of up to 5 mm. This diameter, combined with a maximum bristle length of up to 2.5 mm, results in a maximum outer diameter of up to 10 mm. Outer diameters of for example 6 to 7 mm, and in particular outer diameters of 4.5 mm according to the current standard value for mascara brushes are conceivable. A larger base body provides more space for bristles, thus facilitating the production of cosmetic brushes with a particularly high number of bristles. The bristle length and the diameter of the base body are in particular matched to each other so as to ensure a well-proportioned and pleasing optical appearance and to fulfill the desired function in a satisfactory manner.

The base body of the brush may have various cross-sectional geometries, preferably a round one. A non-round cross-section is however also conceivable.

According to another favorable embodiment, the base body extends conically in the direction of a central axis. Thus, the cross-sectional area decreases in particular with decreasing distance from a front tip of the cosmetic brush. This results in a bristle density that continuously increases towards the top, wherein a high bristle density in the above range is however already provided at the opposite end of the bristle portion, i.e. at the end facing the wand portion.

Another preferred embodiment is characterized in that the base body has a cross-sectional profile that varies in the direction of a central axis. Thus, in certain portions, the cross-section of the base body may increase or decrease, for example. As a result, partial areas are obtained in which the high bristle density is either lower or higher. The bristle density may therefore in particular also vary in one way or another in the longitudinal direction.

Moreover, it is advantageously provided that each of the bristles has a conical shape pointing outwards with a cone angle of 1° to 5°, in particular of approximately 4°. The in particular round cross-sectional area of these conical bristles decreases with increasing distance from a surface of the base body. A certain conicity of the bristles facilitates ejection of the finished brush from the tool used for injection molding. On the other hand, conicity should not exceed a certain value in order to ensure a high bristle density. The conical shape of the bristles is particularly suitable for the small bristle geometries that are due to the high bristle densities. Due to the favorable conical shape, the bristles have a very high tensile strength and a very high self-erecting capability despite their small cross-sectional areas and the hard plastic materials that are used.

According to another favorable embodiment, the bristles have a rounded bristle tip at their respective outer end with a radius of the rounded tip of at most 0.05 mm. This rounding prevents the bristles from clinging to lashes or hair and simultaneously enables precise separation of lashes or hair, even if they are disposed one above the other and not next to each other.

Moreover, the bristle surface may be in particular smooth or provided with a structure.

Also, it is preferably conceivable for the bristles to be disposed about a longitudinal axis of the cosmetic brush in a ring-like manner, wherein each ring may be composed of up to approximately 50 bristles.

Further features, advantages and details of the invention will become apparent from the ensuing description of embodiments, taken in conjunction with the drawing:

BRIEF DESCRIPTION OF THE DRAWINGS

Corresponding parts are denoted by the same reference numerals in FIGS. 1 to 5.

DESCRIPTION OF THE PREFERRED EMBODIMENTS

Figure 1:
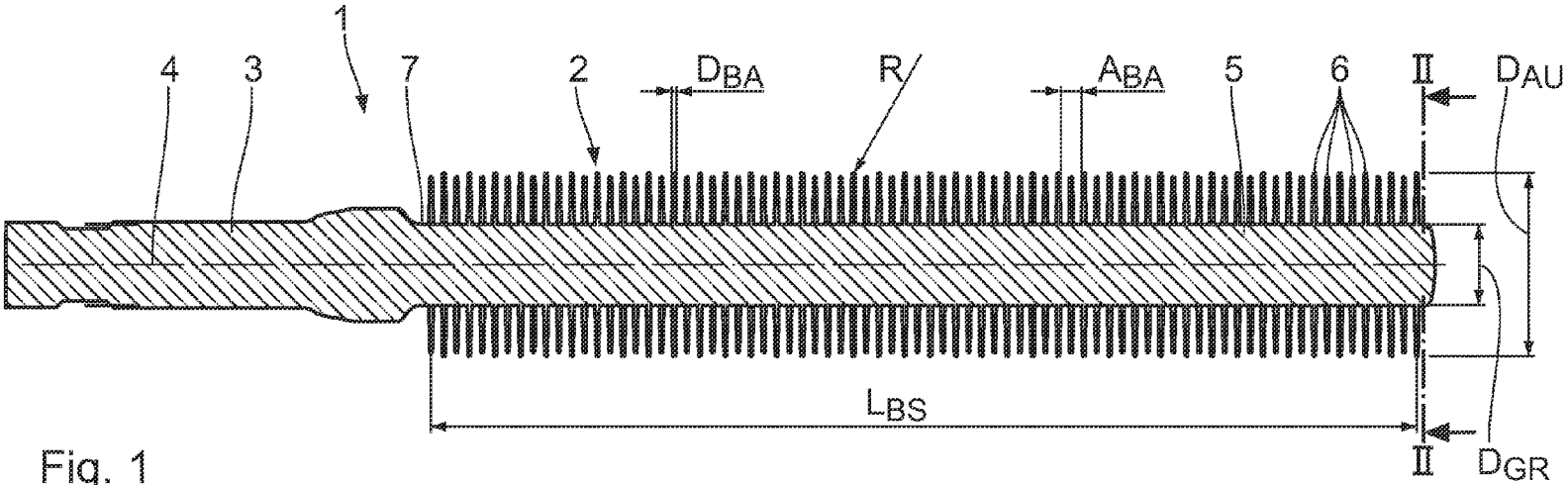
FIG. 1 shows a longitudinal section through an embodiment of a cosmetic brush with a high bristle density.
Figure 2:
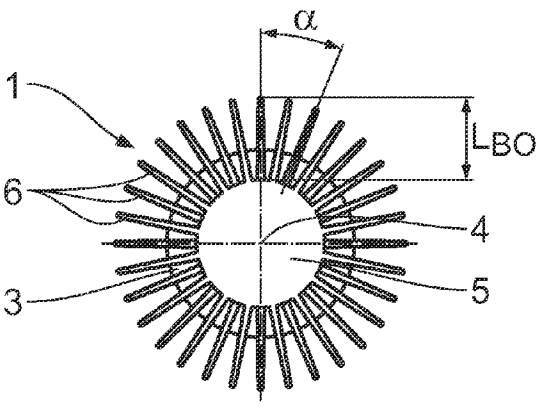
FIG. 2 shows the section of the cosmetic brush according to FIG. 1 along the line II-II in FIG. 1.

FIGS. 1 and 2 show an exemplified embodiment of a cosmetic brush 1 in the shape of a mascara brush. The cosmetic brush 1 is a one-piece injection molded plastic part with a round cross-sectional geometry. The main portion of the injection molded cosmetic brush 1 comprises a bristle portion 2 and a wand portion 3 formed axially thereon, the bristle portion 2 and the wand portion 3 extending in the direction of a central axis 4. The bristle portion 2 comprises a central base body 5 serving as a carrier for a plurality of bristles 6 that stick out from the base body in a radial direction. The bristles 6 each form one piece with a circumferential area 7 of the base body 5. The base body 5 and the wand portion 3 are rotationally symmetric with respect to the central axis 4. In alternative embodiments not shown, the base body may basically also have a non-round cross-section and/or a longitudinal profile that extends conically in the direction of the central axis 4 or varies in any other way.

All partial components of the cosmetic brush 1, i.e. the wand portion 3, the base body 5 and the bristles 6, are composed of a uniform, relatively hard plastic material and are produced in a single-stage injection-molding process. The plastic material of the described embodiment is a plasticizer-free polyamide with a Shore hardness D of approximately 54 and a density of approximately 1.02 g/cm$^3$, the density being determined according to DIN EN ISO 1183. However, other plastic materials that are preferably also plasticizer-free and have a high Shore hardness D of in particular more than 40 and preferably of more than 45 are basically also suitable for use in this application. Alternative materials are for example a polyester material of a corresponding hardness or polyacrylics. Furthermore, plastic materials that are particularly suitable for this application have a density according to DIN EN ISO 1183 in the range of between 0.95 g/cm$^3$ and 1.30 g/cm$^3$, preferably between 0.98 g/cm$^3$ and 1.04 g/cm$^3$. Moreover, as far as chemical compatibility is concerned, these preferred plastic materials are fully compatible with the cosmetic product to be applied by means of the cosmetic brush 1.

The hard plastic material that is used allows the cosmetic brush 1 to be provided with a very high bristle density and, therefore, with a very high number of bristles.

As can be seen from FIG. 2, the bristles 6 of the exemplified embodiment are disposed in bristle rings of 16 bristles 6 each that are evenly distributed in a circumferential direction. Adjacent bristles 6 of a bristle ring are offset from each other in the circumferential direction by a bristle offset angle $\alpha$ of 22.5°. The bristle portion 2 has a standard trim length $L_{BS}$ of approximately 25 mm along which the total of 78 bristle rings of the exemplified embodiment are disposed. The cosmetic brush 1 shown in FIGS. 1 and 2 thus has a number of bristles amounting to 1248 and an average bristle density of approximately 8.1 bristles/mm$^2$, the circumferential area 7 of the base body 5 serving as a reference area.

The exemplified embodiment furthermore exhibits the following geometrical parameters:

The base body 5 has a base body diameter $D_{GR}$ of 2 mm, and the bristle portion has an outer diameter $D_{AU}$ of 4.5 mm, the outer diameter being determined by the base body 5 and the bristles 6 that are formed thereon. Accordingly, the bristles 6 have a bristle length $L_{BO}$ of 1.25 mm.

Figure 3:
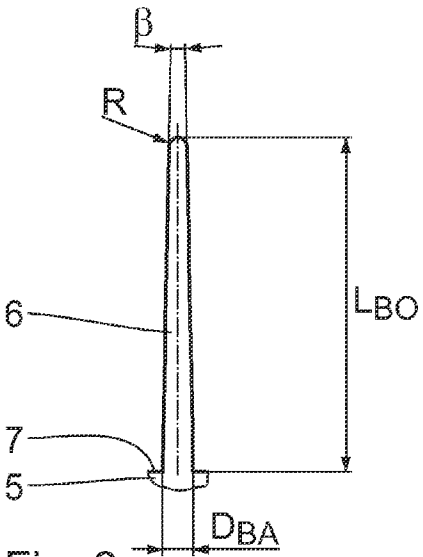
FIG. 3 shows a bristle of the cosmetic brush according to FIG. 1.

As can be seen from the enlarged representation of a single one of the bristles 6 shown in FIG. 3, the bristles 6 have a conical shape that converges outwards, forming a cone angle $\beta$ of 4°. Accordingly, the round cross-sectional area at the base, i.e. at the point of contact with the base body 5, is larger than at the outer end area of the bristle 6. The bristles 6 have a base diameter $D_{BA}$ of 0.166 mm, their outer free end forming a rounded tip wherein the radius R of the rounded tip amounts to 0.038 mm. Bristles 6 disposed next to each other in the direction of the central axis 4 have a base distance $A_{BA}$ between their respective bases that amounts to 0.63 mm.

Figure 4:
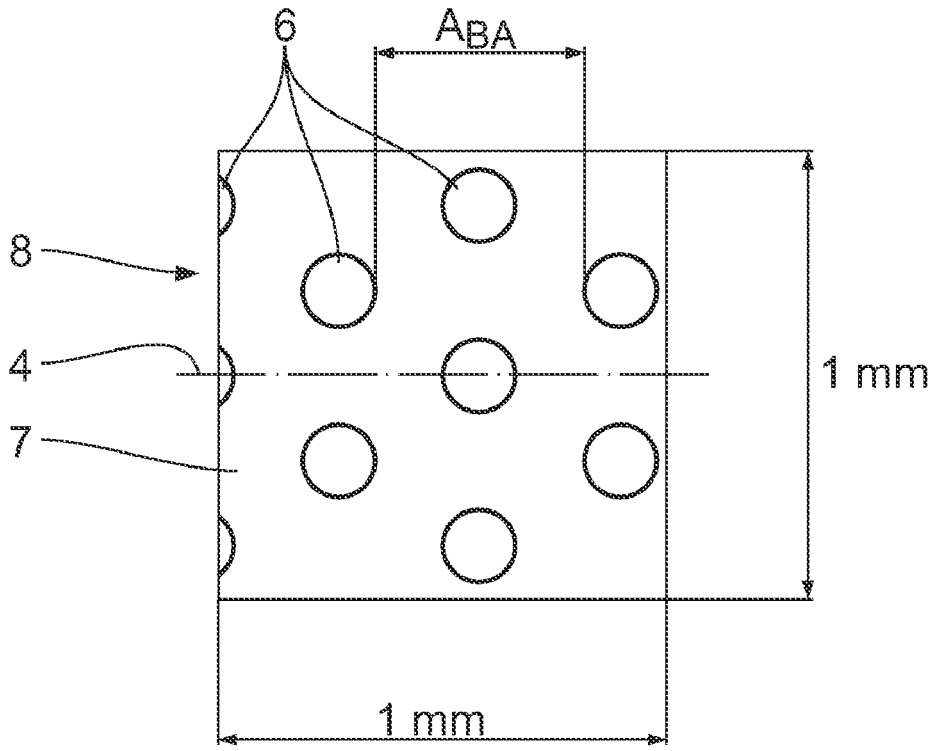
FIGS. 4 and 5 each show a developed section of a circumferential area of an embodiment of a cosmetic brush, each of which displaying a high but different bristle density.
Figure 5:
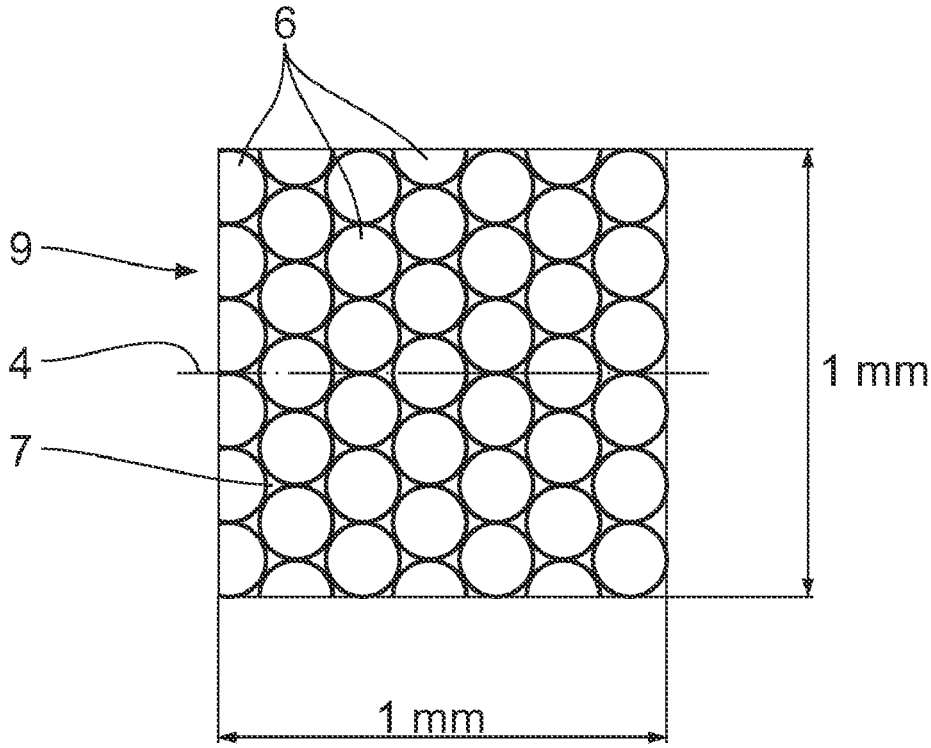

It becomes apparent from the sections of developed outer circumferential areas of cosmetic brushes shown in FIGS. 4 and 5, wherein each of the cosmetic brushes has a different bristle density, that the bristles 6 are disposed in parallel longitudinal rows, wherein bristles 6 that are disposed next to each other in the longitudinal rows have a uniform distance with respect to each other, the distance being determined by a modular row size, and adjacent longitudinal rows are each disposed at an offset of half a modular row size with respect to each other when seen in the longitudinal direction of the longitudinal rows. This applies in particular when seen in the direction of the central axis 4 as well as when seen in the circumferential direction that is perpendicular to the direction of the central axis. This offset arrangement of the bristles 6 enables a high bristle density to be obtained.

FIG. 4 shows a section of a developed circumferential area 7 of a cosmetic brush 8 with a bristle density of 7 bristles/mm$^2$, the section having a size of 1 mm×1 mm. Using a base body 5 that has the same dimensions as in the cosmetic brush 1 according to FIGS. 1 and 2, a number of bristles is obtained that amounts to slightly more than 1000, strictly speaking to 1078.

FIG. 5 shows a section of a developed circumferential area 7 of a cosmetic brush 9 with a bristle density of 42 bristles/mm$^2$, the section having a size of 1 mm×1 mm. This is the highest bristle density that can be obtained with the bristle diameter selected for this exemplified embodiment. Higher values are only attainable by reducing the bristle diameter.

What is claimed is:

1. A cosmetic brush, such as a mascara brush or brush for dying hair, comprising a bristle portion (2) with a base body made of a plastic material (5) and a plurality of non-tufted stand-alone bristles (6) that stick out from the base body (5) in a radial direction and serve for an application of a cosmetic product, wherein each of said bristles (6) forms one integrally molded piece with a circumferential area (7) of the base body (5), and wherein the bristles (6) have a high bristle density of at least 6 bristles (6) per square millimeter and consist of a plastic material that has a Shore hardness D of more than 40.

2. A cosmetic brush according to claim 1, wherein the plastic material has a Shore hardness D of at least 45.

3. A cosmetic brush according to claim 1, wherein the plastic material has a Shore hardness D of at most 60.

4. A cosmetic brush according to claim 1, wherein the bristle density amounts to a maximum of 50 bristles (6) per square millimeter.

5. A cosmetic brush according to claim 1, wherein the bristle portion (2) has a trim length ($L_{BS}$) along which bristles (6) are disposed that amounts to between 18 mm and 30 mm and extends in the direction of a central axis (4).

6. A cosmetic brush according to claim 1, wherein bristles (6) that are disposed next to each other on a surface (7) of the base body (5) have a base distance ($A_{BA}$) of at most 0.63 mm with respect to each other.

7. A cosmetic brush according to claim 1, wherein the bristles (6) on a surface (7) of the base body (5) have a base diameter ($D_{BA}$) of at most 0.3 mm with respect to each other.

8. A cosmetic brush according to claim 1, wherein the bristles (6) on a surface (7) of the base body (5) have a base diameter ($D_{BA}$) of at most 0.166 mm with respect to each other.

9. A cosmetic brush according to claim 1, wherein the bristles (6) have a bristle length ($L_{BO}$) of at most 2.5 mm and stick out from a surface (7) of the base body (5).

10. A cosmetic brush according to claim 1, wherein the base body (5) has a diameter ($D_{GR}$) of up to 5 mm.

11. A cosmetic brush according to claim 1, wherein the bristles (6) each have a conical shape that converges outwards, thus forming a cone angle ($\beta$) of 1° to 5°.

12. A cosmetic brush according to claim 1, wherein the bristles (6) each have a conical shape that converges outwards, thus forming a cone angle ($\beta$) of approximately 4°.

13. A cosmetic brush according to claim 1, wherein the bristles (6) have a rounded tip at their respective outer end with a radius (R) of the rounded tip of at most 0.05 mm.

14. A cosmetic brush according to claim 1, wherein the plastic material has a density in the range of between 0.95 g/cm$^3$ and 1.30 g/cm$^3$.

15. A cosmetic brush according to claim 1, wherein the plastic material has a density in the range of between 0.98 g/cm$^3$ and 1.04 g/cm$^3$.

16. A cosmetic brush, such as a mascara brush or brush for dying hair, comprising a bristle portion (2) with a base body made of a plastic material (5) and a plurality of non-tufted stand-alone bristles (6) that stick out from the base body (5) in a radial direction and serve for an application of a cosmetic product, wherein each of said bristles (6) forms one integrally molded piece with a circumferential area (7) of the base body (5), and wherein the bristles (6) have a high bristle density of at least 6 bristles (6) per square millimeter and consist of a plastic material that has a Shore hardness D of more than 40, wherein individual bristles of said plurality of bristles (6) are disposed in parallel longitudinal rows, with respect to a longitudinal axis of the brush, and wherein the individual bristles that are disposed next to one another in the longitudinal rows have a uniform distance with respect to each other when viewed in the longitudinal direction of the longitudinal rows and when viewed in a circumferential direction that is perpendicular to the direction of the longitudinal axis, the distance being determined by a modular row size, and adjacent longitudinal and circumferential rows being each disposed at an offset of half the modular row size with respect to each other.

* * * * *